US005077840A

United States Patent [19]

Masters et al.

[11] Patent Number: 5,077,840

[45] Date of Patent: Jan. 7, 1992

[54] CHANNELLING APPARATUS FOR A TOILET

[76] Inventors: Jeffrey B. Masters; Carol S. Masters, both of 7 The Bramblings, Poulton-le-Fylde, Lancs., United Kingdom, F76 7UH

[21] Appl. No.: 500,575

[22] Filed: Mar. 28, 1990

[30] Foreign Application Priority Data

| | | | |
|---|---|---|---|
| Mar. 31, 1989 | [GB] | United Kingdom | 8907293 |
| Apr. 19, 1989 | [GB] | United Kingdom | 8908855 |
| Oct. 25, 1989 | [GB] | United Kingdom | 8923993 |

[51] Int. Cl.[5] ..... E03D 9/00

[52] U.S. Cl. ..... 4/300.3; 4/DIG. 5

[58] Field of Search ..... 4/300.3, DIG. 5, 661, 4/300, 314, 315, 340, 341, 342, 420.3, 445, 666, 144.1

[56] References Cited

U.S. PATENT DOCUMENTS

| | | | |
|---|---|---|---|
| D. 110,120 | 6/1938 | Kraus | 4/DIG. 5 |
| 1,358,933 | 11/1920 | Collins | 4/DIG. 5 X |
| 2,427,807 | 9/1947 | Oliver | 4/445 |
| 2,583,718 | 1/1952 | Walls | 4/300.3 X |
| 2,592,040 | 4/1952 | La Hue | 4/144.1 |
| 2,791,780 | 5/1957 | Krischer | 4/DIG. 5 |
| 2,980,919 | 4/1961 | Otto et al. | 4/300.3 |
| 3,071,778 | 1/1963 | Renshaw | 4/DIG. 5 X |
| 3,193,845 | 7/1965 | Funk | 4/300.3 |
| 4,348,776 | 9/1982 | Sarjeant | 4/DIG. 5 |
| 4,612,676 | 9/1986 | Whitman | 4/300.3 |
| 4,716,602 | 1/1988 | Brickhouse | 4/DIG. 5 X |

*Primary Examiner*—Henry J. Recla
*Assistant Examiner*—Robert M. Fetsuga
*Attorney, Agent, or Firm*—Foley & Lardner

[57] ABSTRACT

In order to reduce incidents of misdirecting urine into a toilet pan the present disclosure proposes apparatus comprising a preformed shape sustaining open channel member with an outlet to one end and a support member, preferably a generally C-shaped flanges carried by the channel member outwardly thereof and adapted, in use, to rest on the rim of the toilet pan to support the open channel member in a free-standing manner without reliance on resilience thereof, the channel member extends upwardly in a direction above the rim and with its outlet extending into the pan. Improved stability of the apparatus results when the longitudinal axis of the open channel member is inclined relative to the plane of the support member—such as to tip the channel member forwardly for the case of a forward facing channel member positioned on the rear part of the pan rim.

7 Claims, 2 Drawing Sheets

CHANNELLING APPARATUS FOR A TOILET

The present invention relates to toilet hygiene and in particular to a means of assisting use of a standard toilet pan by a male child but without limitation to such.

It is well known that the toilet training of children presents problems, at least in the transition from a potty to the ability to use a full size toilet. Adapters have been used to enable young children to sit on a standard toilet which would otherwise be too large, but to our knowledge no attention has been directed to avoiding spillage when young boys or other males standing at a toilet for the purpose of passing urine are unable to control their aim satisfactorily solely into the pan. Visits may be made in a state of trance without concentration as to aim. Misdirecting of urine in this manner provides additional work for hardpressed parents as well as creating potentially unhygeinic conditions and undersirable odours.

It has an aim of the present invention to provide a means of reducing the likelihood of misdirecting urine into the toilet pan.

Accordingly, a preferred aspect of the present invention provides apparatus for channelling urine into a toilet pan comprising a preformed shape sustaining open channel member with an outlet to one end, and support means of or associated with said member, preferably comprising at least one flange or like part, disposed outwardly of the open channel member and adapted, in use, to rest on the rim of the toilet pan to support the open channel member in a free-standing self-supporting manner without reliance on resilience of the channel member, the channel member extending upwardly in a direction above said rim and with its outlet extending into the pan.

It is preferred for the support means to be one or more separate members adapted for cooperating engagement with the channel member. More particularly the separate member or members are adapted to be received in recessing. Preferably the recessing is defined between spaced ribs or lugs formed in the channel member or comprises localised thinning of the channel member wall thickness. More particularly the support means comprises a simple flange; preferably as a planar generally C-shaped member and with hook like end formations for embracing respective open edges of the channel member. More particularly still, the channel member is generally rectilinear and its axis is disposed at an angle relative to the plane of the support means. The flange may be a shrink on fit.

In one embodiment the angle between the open side of the channel and the plane of the support means is acute whilst in another it is obtuse. The two embodiments serve different functions, but in either case the angling is such as to aid stability in use and ensure that the apparatus is supported in a free-standing self-supporting manner. Said one embodiment is intended for positioning on the rear part of the toilet pan and with the open channel member facing forwardly (towards the user) and it has been found that angling the plane of the support means at from 3 degrees to 9 degrees to a plane normal to the channel axis provides adequate stability and a preferred angle is 6 degrees. Preferably the uppermost end of the channel member, opposite to the outlet, is closed. The other embodiment is positioned on the forward part of the toilet pan with the open channel member facing upwardly and rearwardly and with the upper end of the open channel member, opposite to the outlet, being open and extending forwardly of the inner rim of the pan.

It will be appreciated that the support means could comprise separate flange members, rods or strip-like parts which are adapted to be fitted to the channel member or integral parts and it is preferred that these define a support plane which affords the aforementioned free-standing self-supporting arrangement of the apparatus.

One aspect of the present invention provides shielding apparatus adapted for use with a toilet pan and comprising a plate or tray-like or channel member positioned in use to extend at least upwardly in a direction above the top of the pan, and preferably having a portion which extends into the pan usually by a lesser degree than its upward extension, and means for locating or supporting the apparatus in position in association with the pan.

More particularly, the support means may comprise abutments for resting on the top of the pan with these abutments positioned to opposite sides of the apparatus, and may comprise further additional retention means engaging either the pan or a seat part of the toilet, especially to the rear of the baffle. The support means may be formed integrally with the channel or as separate parts. They may be such as spring clip or screw action means or strip or rod-like members extending from the channel bit, preferably comprise a simple flange say of generally C-shaped. In one embodiment that additional retention means may usefully comprise a hook or like part for locating over the rear edge of the toilet seat when its in its raised position. The retaining means conveniently has an arm engaging in a slotted bar or recess formed at the rear of the baffle. The side abutments may be formed as an out-turned lip from a U-shaped part of a locating clip, which U-shaped part is dimensioned to receive the bottom edge of the channel member. The clip may be of solid material, such as plastics, or made by bending-upwire, for which plastics coated wire is particularly suitable.

In one embodiment the further retention means comprises a flange-like element of or associated with the rear of the baffle and extending in use to fit between the pan and the toilet seat hinge part. More preferably the flange-like part is angled downwardly way from the baffle to provide gripping engagement with the hinge part or between the hinge part and the pan. The inclination also serves to tip the channel member slightly forwardly. The flange is of a sufficient length to permit forward and aft adjustment of the position of the channel member on the pan.

Said flange may be as a further abutment attaching to the channel member at the rear but otherwise in the same or a similar manner to those of the side abutments. A particularly simple embodiment utilises rods, say three extending from the channel member to define two side and one rear abutment. Such rods may conveniently extend from sleeve-like retention parts provided on the baffle, say as metal rods fitting into the sleeves. Preferably the side sleeves are positioned at a different height to the rear or positioned to angle the baffle. A yet further alternative embodiment provides the abutments as a skirt or collar in the form of a Y-shaped flange locating with the channel member by way of abutments thereof either as discrete lugs to retain vertically, or as a groove, then affording entry of the collar as a slide fit from the rear or as a snap fit over raised lugs. The stem of the collar provides the rearward retention means for cooperation with the hinge part as aforedescribed.

The channel member is so shaped to provide top and side parts either as distinct parts extending forwardly from a rear wall or more preferably as a smooth transition from a rear surface to forward facing edge parts. i.e. The channel member may comprise a tray-like member vertically orientated but omitting the lower most edge to facilitate draining into the pan. More particularly the channel member is moulded as a smooth three dimensioned curved surface, say semicircular in cross section at its lower most extremity and merging into a part-hemispherical shape for the top portion. The shield apparatus can be readily made as a plastics moulding.

In one embodiment the shield is preferably constructed to be set at an angle to the vertical, i.e. angled toward the user, by varying the position of the supports. Preferably they are fixed but could be adjustable.

The present invention will now be described further, by way of example only, with reference to the accompanying drawings; in which.

Figure 1:
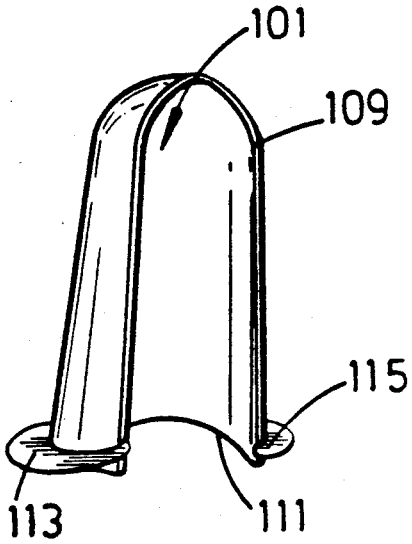
FIG. 1 is a perspective view of a first embodiment of apparatus according to the invention.
Figure 2:
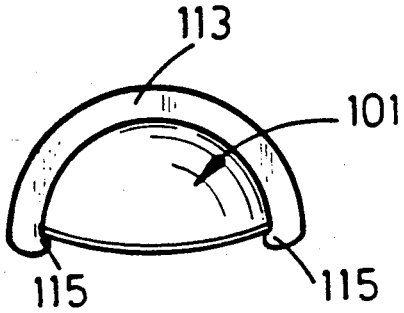
FIG. 2 is a plan view of the apparatus of FIG. 1.

Referring first to FIGS. 1 and 2 there is shown apparatus according to the invention comprising a channel member 101 formed as a plastics moulding and open to one side defined by continuous edge 109, and open to one end, defined by edge 111. The cross section of the channel is generally semi-circular and closed to the end opposite the edge 111 by a part spherical configuration. The channel member is configured to receive support means which in the illustrated embodiment is in the form of a planar flange 113 of generally C-shape. The flange has turned in ends 115 to embrace the edge 109 to opposite walls of the channel member. The flange fits in the recessing around the outside of the channel member defined between spaced ribs or lugs see for example FIG. 8 in relation to flange 39—which construction is equally applicable to this embodiment. The recessing is inclined relative to the general direction of the channel member so that when the flange rests on the toilet pan the channel member is tilted forwardly. This serves to aid stability in use of the apparatus. An angle of 6 degrees is particularly suitable. The angling is illustrated by way of example with reference to FIG. 5 in which the dotted lines 141, 143 represent the ribs defining the angled recessing. The flange member is may be a push fit into position and may be releasable for cleaning purposes or it may be a shrink on fit by assembly prior to final curing.

The apparatus is intended for positioning in the rear part of the toilet pan with the flange resting on the rim to support the apparatus in a free-standing manner. In that position the outlet end of the channel member extends into the pan and the remainder extends upwardly with the open side of the channel member facing forwardly.

Figure 3:
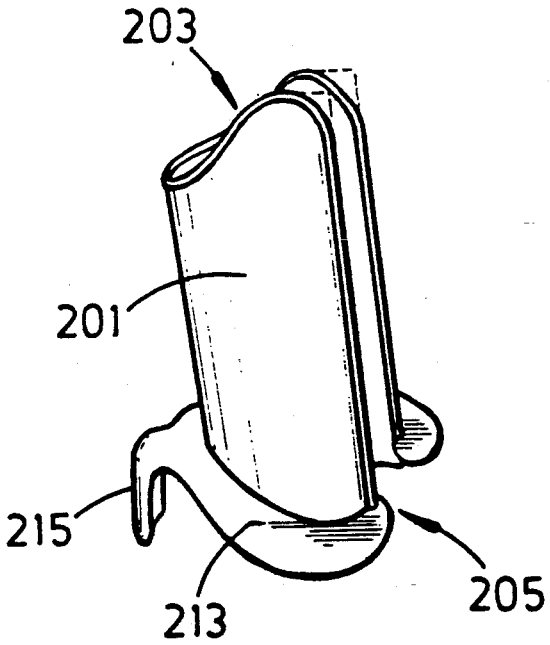
FIG. 3 is a perspective view of a second embodiment of apparatus according to the invention.

Referring now to FIG. 3, there is illustrated an alternative embodiment of apparatus which is intended for positioning on the forward part of a toilet pan. It comprises an open channel member 201 which is open to one side and for this application to both ends 203, 205. Support means takes the form of a flange member 213 received in recessing of the channel member and angled relative to the general direction of the channel member so that in use the flange member rests on the rim of the pan and angles the channel member such that the upper end is disposed forwardly of the lower end. The recessing can be similar to that illustrated with reference to FIG. 8. The flange member has an optional downwardly depending lug 215 which acts to locate the apparatus on the rim of the toilet i.e. the rim is disposed between the lug 215 and downwardly depending part of the channel member relative to the disposition of the flange member. In use, the apparatus serves to channel into the toilet pan urine which might otherwise fall short of the pan.

Figure 4:
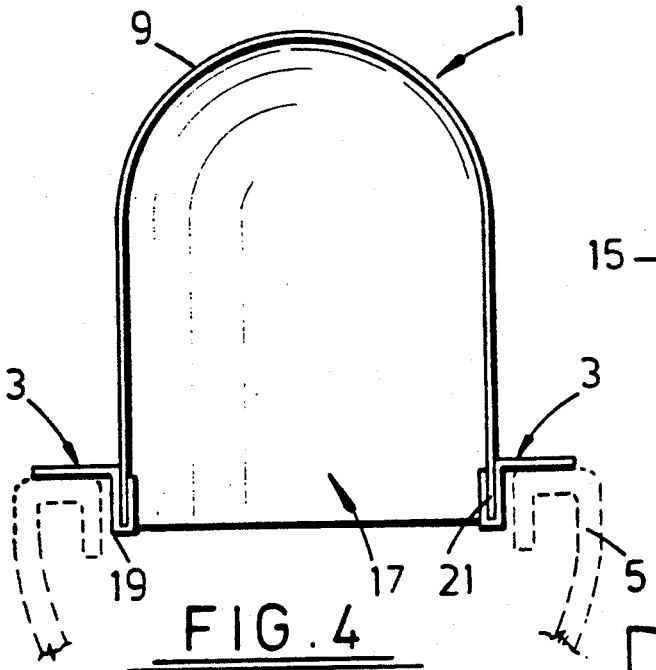
FIG. 4 is a front view of the apparatus similar to FIG. 1 but with modified support means.
Figure 5:
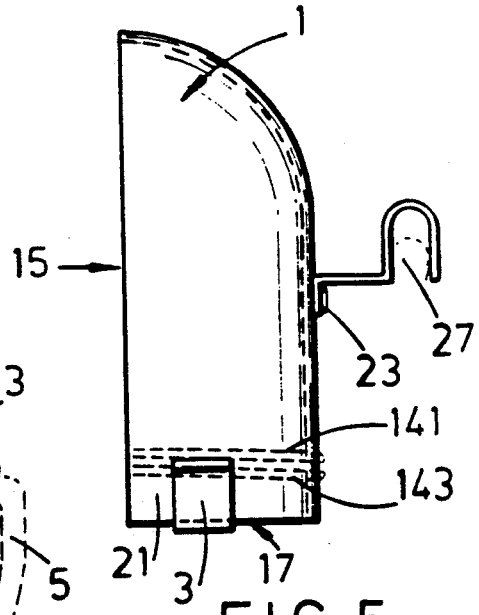
FIG. 5 is a side view of the apparatus of FIG. 4.
Figure 6:
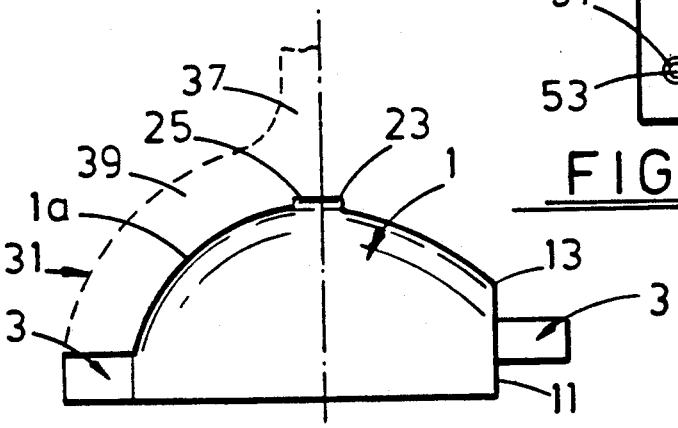
FIG. 6 is a plan view of the apparatus of FIGS. 4 and 5 showing alternative shapes.

Referring to the drawings of FIGS. 4, 5 and 6 the shield apparatus according to the illustrated embodiment comprises a plastic moulded tray-like part 1 of three dimensional shape translating from a forwardly facing rear face to inwardly facing side edges defined by forward edge 9. The lower portion of the tray is preferably semicircular and the upper portion part spherical 1 as shown with reference to the left hand side of FIG. 6. The right hand side of FIG. 6 shows an alternative construction with more sharply defined side parts 11 each merged with a curved rear wall 16 as at 13. The tray-like shape is open to the front as indicated by arrow 15 and also to the bottom as indicated by arrow 17. Abutments 3 are formed as out-turned flanges from a U-shaped clip portion 19 which is dimensioned to receive the bottom edge 21 of the tray like part. Also shown is strapping 23 secured to the rear of the tray-like part and providing recess 25 to receive a hook like part 27.

In use the shield apparatus is rested on the top surface of the pan as shown in dotted outline at 5 and the hook member 27 fits to either side of the upturned seat so as to hold the apparatus stable in use. The length of the hook is dimensioned to position the shield apparatus approximately ⅓ to half way from the rear of the pan. It will be appreciated that with the shield in position any urine whose trajectory would otherwise miss the pan is intercepted and thereby drains into the pan.

Figure 7:
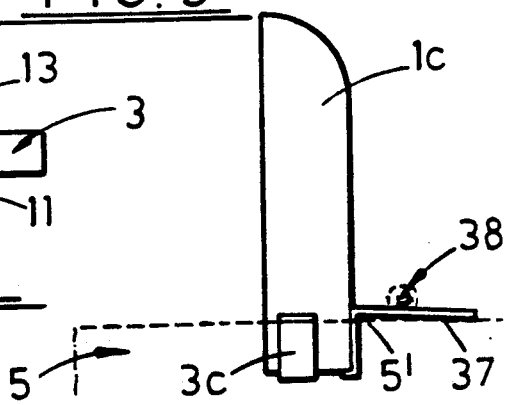
FIG. 7 is a side view of a further modified embodiment.

Referring now to FIG. 7, here the aforementioned retention means is formed by a flange-like member 37 which extends from the rear of the baffle or channel member, shown as clipping in place in the same manner, as side abutments 3*c*. In use the flange-like part fits between a hinge part 38 of the toilet seat and the pan surface 5' and is of a length to allow forward and aft adjustment of baffle positioning. The flange is inclined (downwardly in the illustration—but could be upwardly) to assist with required location as well as biasing the baffle forwardly.

Figure 8:
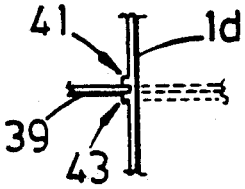
FIG. 8 is a fragmentary section showing details of the support means locator such as for the embodiment of FIGS. 1 and 2.

An alternative to separate abutments for 3*c* and 37 is to have a one piece Y-shaped collar 39 as illustrated in FIG. 8 and shown dotted in the left half of FIG. 6. This is located in a groove between abutments 41, 43 and is readily inserted from the rear.

Figure 9:
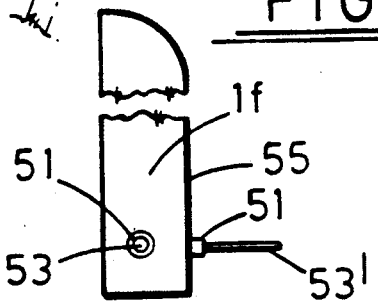
FIG. 9 is a fragmentary side view of yet another embodiment of support means.

Finally referring to FIG. 9 there is shown a side view of an alternative embodiment with a modified fixing system. Parts corresponding to those in FIG. 4 have been suffixed with the letter *f*. The channel member 1*f* is provided with sleeving 51 having a bore to receive a respective rod 53. Two sleeves 51 are provided to opposite sides and a third to the rear. The channel member 1*f* is preferably a plastics moulding and the sleeves are moulded integrally therewith and projecting approximately 10 mm. It is preferred for the rod 53' fitted to the rear sleeve to be smaller diameter and longer than the side rods and is intended to fit between the pan top and the seat hinge part and so allows for fore and aft adjustment. As illustrated the rear sleeve is positioned slightly lower (by approximately the rod diameter 3–5 mm) than the side sleeves and this is done so that in use a rear wall 55 of the channel member is angled forward. The rods are preferably metal suitably treated to resist corrosion. This embodiment has the advantage that it minimises moulding costs. The rods 53, 53' are push fit into the sleeves.

We claim:

1. Apparatus for use by a male standing in front of a toilet bowl for channelling urine into the bowl, the toilet bowl having a rim, the apparatus comprising a preformed shape sustaining elongated channel member, said channel member having a longitudinal axis oriented in a vertical plane and having vertical edges extending substantially the full height thereof defining an opening, support means for supporting said channel member on the toilet bowl rim, said support means being substantially planar and disposed adjacent a bottom end of said channel member, said support means further extending substantially transverse to said longitudinal axis and from one of said vertical edges, around said channel member and terminating at the other of said vertical edges, said support means being adapted to be positioned on the toilet bowl rim in non-gripping engagement therewith to orient said channel member opening towards the front of the toilet bowl, said support means being positioned on said channel member such that the plane defined by said support means defines a forwardly directed acute angle with said longitudinal axis of said channel member to provide stability when said channel member is positioned on the toilet bowl rim.

2. Apparatus as claimed in claim 1 wherein the support means comprises at least one separate member connected to the channel member.

3. Apparatus as claimed in claim 2 wherein a recess is provided in the channel member which receives the at least one separate member.

4. Apparatus as claimed in claim 1 wherein the support means comprises a single flange.

5. Apparatus as claimed in claim 4 wherein the flange is a planar generally C-shaped member having hook-like end formations engaging the vertical edges of the channel member.

6. Apparatus claimed in claim 1 wherein the plane of the support means is inclined at an angle between 3 degrees and 9 degrees to a plane normal to the channel member longitudinal axis.

7. Apparatus as claimed in claim 1 in which the top end of the channel member is closed.

* * * * *